US009162517B2

(12) United States Patent
Cecchini

(10) Patent No.: US 9,162,517 B2
(45) Date of Patent: Oct. 20, 2015

(54) SAFETY TACK

(76) Inventor: Albert Cecchini, Jamestown, NY (US)

( * ) Notice: Subject to any disclaimer, the term of this patent is extended or adjusted under 35 U.S.C. 154(b) by 18 days.

(21) Appl. No.: 13/189,106

(22) Filed: Jul. 22, 2011

(65) Prior Publication Data

US 2012/0020757 A1 Jan. 26, 2012

Related U.S. Application Data

(60) Provisional application No. 61/400,156, filed on Jul. 23, 2010.

(51) Int. Cl.
*B43M 15/00* (2006.01)

(52) U.S. Cl.
CPC ..... *B43M 15/00* (2013.01)

(58) Field of Classification Search
CPC ..... B43M 15/00
USPC ..... 411/439; 24/710.4; 401/91
See application file for complete search history.

(56) References Cited

U.S. PATENT DOCUMENTS

| | | | | | |
|---|---|---|---|---|---|
| 1,066,288 | A | * | 7/1913 | Kokernot | 24/710.4 |
| 1,430,401 | A | * | 9/1922 | Peralta | 401/79 |
| 1,857,158 | A | | 5/1932 | Maloney et al. | |
| 1,976,747 | A | | 10/1934 | Reuter et al. | |
| 2,335,957 | A | * | 12/1943 | Oliver | 411/487 |
| 2,518,977 | A | | 8/1950 | Conway | |
| 2,550,549 | A | | 4/1951 | Goodstein | |
| 2,624,314 | A | | 1/1953 | Spatz et al. | |
| 3,101,477 | A | | 8/1963 | Leniz | |
| 3,205,757 | A | | 9/1965 | Kuennen | |
| 3,357,063 | A | | 12/1967 | Eiben | |
| 3,396,438 | A | * | 8/1968 | White | 24/707.7 |
| 3,672,783 | A | | 6/1972 | Bajusz | |
| 3,819,282 | A | | 6/1974 | Schultz | |
| 3,995,821 | A | | 12/1976 | Einhorn | |
| 4,005,507 | A | | 2/1977 | Yamazaki | |
| 4,161,374 | A | | 7/1979 | Koeln et al. | |
| 4,266,881 | A | | 5/1981 | Rubens | |
| 4,786,197 | A | | 11/1988 | Koeln et al. | |
| 4,817,251 | A | * | 4/1989 | Shirley-Smith et al. | 24/710.4 |
| 4,897,007 | A | | 1/1990 | Chen et al. | |
| 5,096,149 | A | | 3/1992 | Riese | |
| 5,630,687 | A | * | 5/1997 | Robinson | 411/372.6 |
| D420,282 | S | | 2/2000 | Jones | |

(Continued)

FOREIGN PATENT DOCUMENTS

| | | | |
|---|---|---|---|
| DE | 558716 | * | 9/1932 |
| GB | 185534 | * | 9/1922 |

(Continued)

OTHER PUBLICATIONS

Oxo—Helen of Troy L.P., "Oxo Good Grips MagTack", http://housewaresdesignawards.com/links/winners_profile.php?ID=344, published 2009, 2 pages.

*Primary Examiner* — Flemming Saether
(74) *Attorney, Agent, or Firm* — Baker & Hostetler LLP

(57) ABSTRACT

A safety tack has a pin that is extended from a head of the tack in one state and retracted into the head in another state. The pin retracts and extends into and from the head by using a turning mechanism similar to the mechanism that allows a bolt to turn into and out of a complementary component (e.g. a nut). By having the retracted state, the tack can be handled without injury; and by having the extended configuration, the tack can be used to tack one object to another.

4 Claims, 12 Drawing Sheets

(56) References Cited

U.S. PATENT DOCUMENTS

| | | | |
|---|---|---|---|
| 6,035,595 | A | 3/2000 | Anderson |
| 6,213,661 | B1 | 4/2001 | Coon |
| 6,276,030 | B1 | 8/2001 | Smith |
| 6,311,404 | B1 | 11/2001 | Smith |
| 6,450,721 | B1 | 9/2002 | D'Amico et al. |
| 6,595,491 | B1 | 7/2003 | Harmon |
| 7,004,703 | B2 | 2/2006 | Johnson et al. |
| 7,226,229 | B1 | 6/2007 | Register |
| 7,470,096 | B2 | 12/2008 | Morrish |
| 7,537,405 | B2 | 5/2009 | Breuer et al. |
| 2002/0098062 | A1 | 7/2002 | Beale |
| 2007/0267555 | A1 | 11/2007 | Signow |
| 2009/0241703 | A1 | 10/2009 | Huang |
| 2011/0129285 | A1 | 6/2011 | Liu |

FOREIGN PATENT DOCUMENTS

| | | | |
|---|---|---|---|
| GB | 543016 | * | 2/1942 |
| KR | 2009/0089276 | | 8/2009 |

* cited by examiner

SAFETY TACK

CROSS REFERENCE TO RELATED APPLICATION

The present application claims priority to U.S. Provisional Patent Application No. 61/400,156, filed Jul. 23, 2010. The contents of that application are hereby incorporated by reference.

TECHNICAL FIELD

The present invention relates to fasteners and more specifically to tacks and pushpins with a safety mechanism.

BACKGROUND

Typically, tacks and pushpins have a similar structure in that they both have a head and a pin extending outwardly from the head. The head is typically spherical, cylindrical, or disk-like in shape.

Tacks and pushpins are convenient; however, they can become a hazard. For example, a tack or pushpin can easily go unnoticed on a floor or chair. This hazard is amplified in a busy classroom or workplace. Pushpins are also commonly a hazard for dressmakers and tailors, who handle large quantities of such items. Usually, a dressmaker or tailor will stick himself or herself when reaching for a pin in a container.

In an attempt to resolve the above-described hazards, pushpins and tacks with safety mechanisms (i.e. safety tacks) have been designed. For example, safety tacks are known and described in a number of United States patents (See U.S. Pat. No. 1,857,158; U.S. Pat. No. 2,518,977; U.S. Pat. No. 4,005,507; and U.S. Pat. No. 6,276,030). In the aforementioned patents, the safety tacks provide safety functionality through a spring-type safety mechanism. Unfortunately, a spring-type safety mechanism for retracting and extending a point of a pin in a tack is impractical to manufacture. U.S. Pat. No. 7,004,703 describes a safety tack with an interesting safety mechanism that is not of the spring-type variety. However, the tack disclosed in U.S. Pat. No. 7,004,703 discloses a tack that appears from its design to be flimsy and unable to withstand repetitive use.

Accordingly, there is a need for a safety tack that minimizes the chances of injury and is simple enough to make manufacturing of the tack practical from a cost perspective.

SUMMARY

The tack described herein is a safety tack that has a relatively simplistic design compared to the designs described in the prior art. Instead of using a spring mechanism, the tack described herein uses a simple turn mechanism enabled by threading, similar to the turn mechanism of a nut and bolt.

Similar to a typical tack, the tack of the invention has a head and a pin with a point. The point is extended from the head by turning a part of the head, and the pin is retracted into the head by turning the same part in the opposite direction. Preferably, the head includes two parts, a first member and a second member, and the turning mechanism is enabled by the two parts. Threading on the first member complements threading on the second member, and combined the first member can turn in and out of the second member or vice versa depending on the embodiment. Alternatively, the pin has threading that combines with threading of the second member allowing the point of the pin to turn in and out of the head. Where the pin includes threading, the pin is fixed to the first member.

DETAILED DESCRIPTION OF ILLUSTRATIVE EMBODIMENTS

Figure 2:
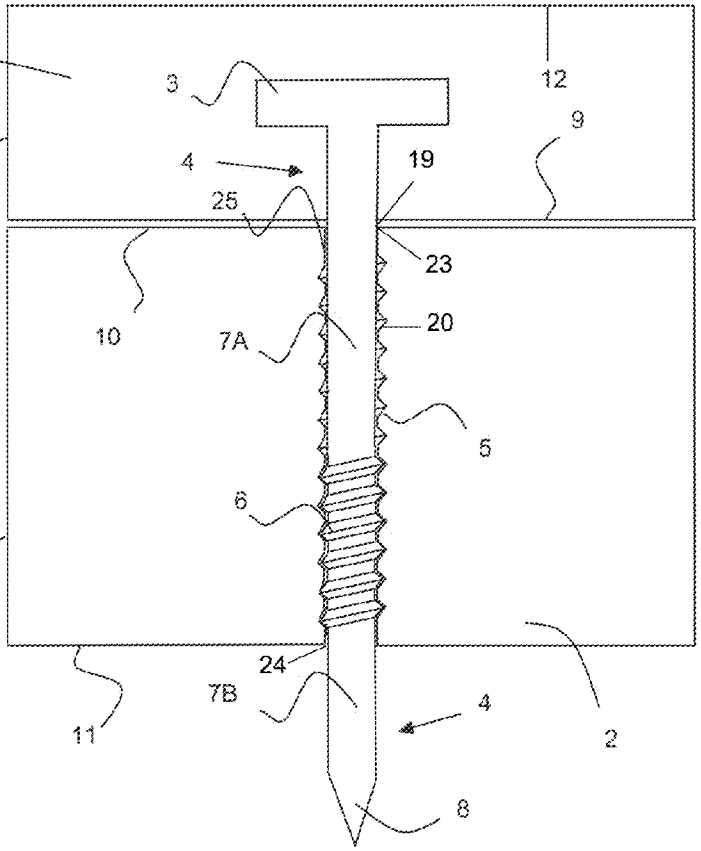
FIGS. 1-5 and 15-20 illustrate cross-sectional perspectives of example embodiments of the safety tack of the invention.

The tack described herein is a safety tack that has a pin element (i.e. pin) having a point where the point can extend from a head element (i.e. head) of the tack in one state of the tack and retract into the head in another state of the tack, and where the extending and retracting of the point is enabled by a turning mechanism. When the point of the pin extends from the head, the point has the ability to puncture an object because the point is exposed and it is not retractable by force of a puncture. When retracted fully, the point does not have the ability to puncture an object, and preferably, the tack includes a stop mechanism (e.g. a barb, thread mismatch, or other mechanism known in the art) on the pin and/or the head, so that the point can be retracted fully without the elements of the tack disconnecting.

Preferably, the pin extends from and retracts into the head by a turning mechanism enabled by a combination of parts including a first member, a second member, and a pin, where the pin is fixed to the first member and where the first member, the second member, or the pin includes a thread that complements another thread of the first member, second member, or pin. An individual element of the tack cannot have both complementary threads.

FIGS. 1-5 illustrate respective embodiments of the tack, where the tack includes the first member 1 fixed to the pin 4, where the pin 4 has a point 8, a bottom portion 7B, a first thread 6, a top portion 7A and an anchor element 3, and where the pin 4 is fixed to the first member 1 by the anchor element 3, which is a part of the top portion 7A of the pin 4. FIGS. 1-4 show various forms of the anchor element 3 and in FIG. 5, an embodiment of the pin 4 is shown without an anchor. The first member 1 further includes a top surface 12, a bottom surface 9, and at least one side surface 14. The tack also includes a second member 2 that includes a hole 19, a top surface 10, a bottom surface 11, and at least one side surface 13, where the hole 19 extends completely through the second member 2, from the top surface 10 of the second member 2 to the bottom surface 11 of the second member 2. The hole 19 includes a wall 20, a top opening 23, a bottom opening 24, and a second thread 5, where the first thread 6 and the second thread 5 are designed to mate with each other. The first thread 6 is positioned between the top portion 7A and the bottom portion 7B of the pin 4 so that the first thread 6 provides for the pin 4 to turn in and out of the second member 2 through the hole 19 by mating the first thread 6 and the second thread 5, and so that the pin 4 can be turned into the second member 2 to an extent that the bottom portion 7B and point 8 of the pin 4 protrude out of the bottom opening 24 of the hole 19 enough to puncture appropriate objects, such as paper and corkboard. Preferably, the pin 4 can be turned into the second member 2 to the extent that the entire bottom portion 7B and point 8 protrude out of the bottom opening 24 of the second member 2, where bottom portion 7B includes the length of the pin 4 from the point 8 to the first thread 6. It is also preferred that the pin 4 can be turned into the second member 2 to the extent that the bottom surface 9 of the first member 1 abuts the top surface 10 of the second member 2. When retracting the pin 4, to prevent the members 1 & 2 from disconnecting, there is a stop mechanism 25.

Figure 1:
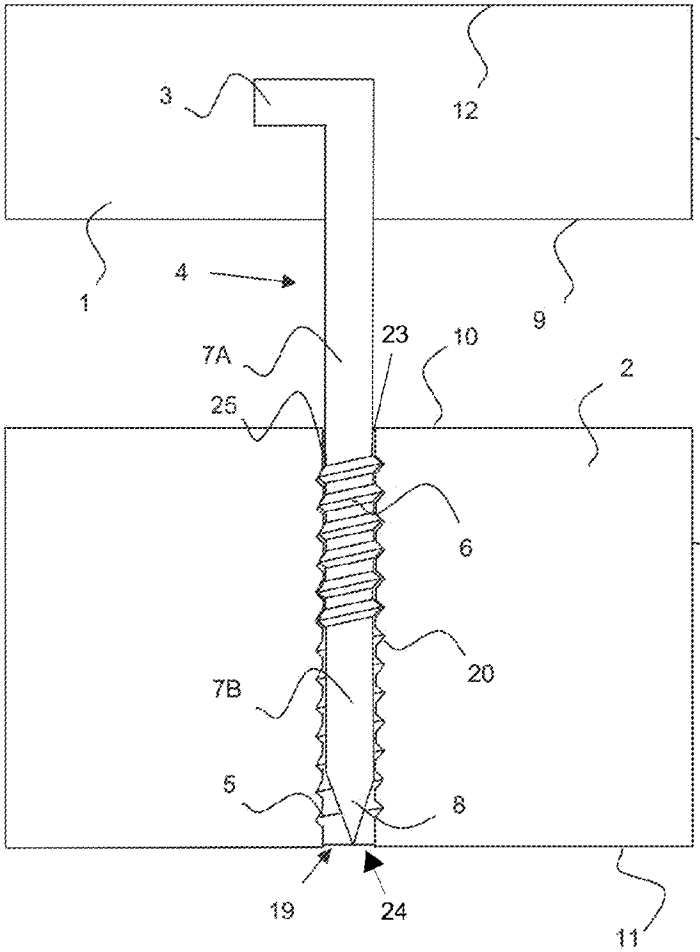
Figure 4:
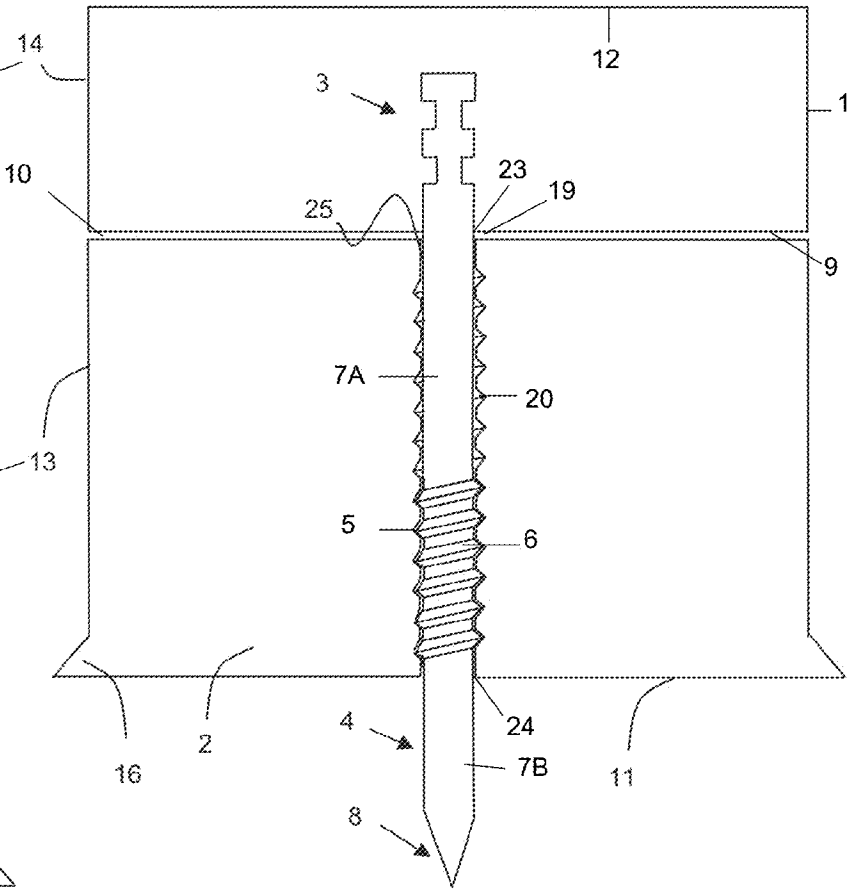
Figure 3:
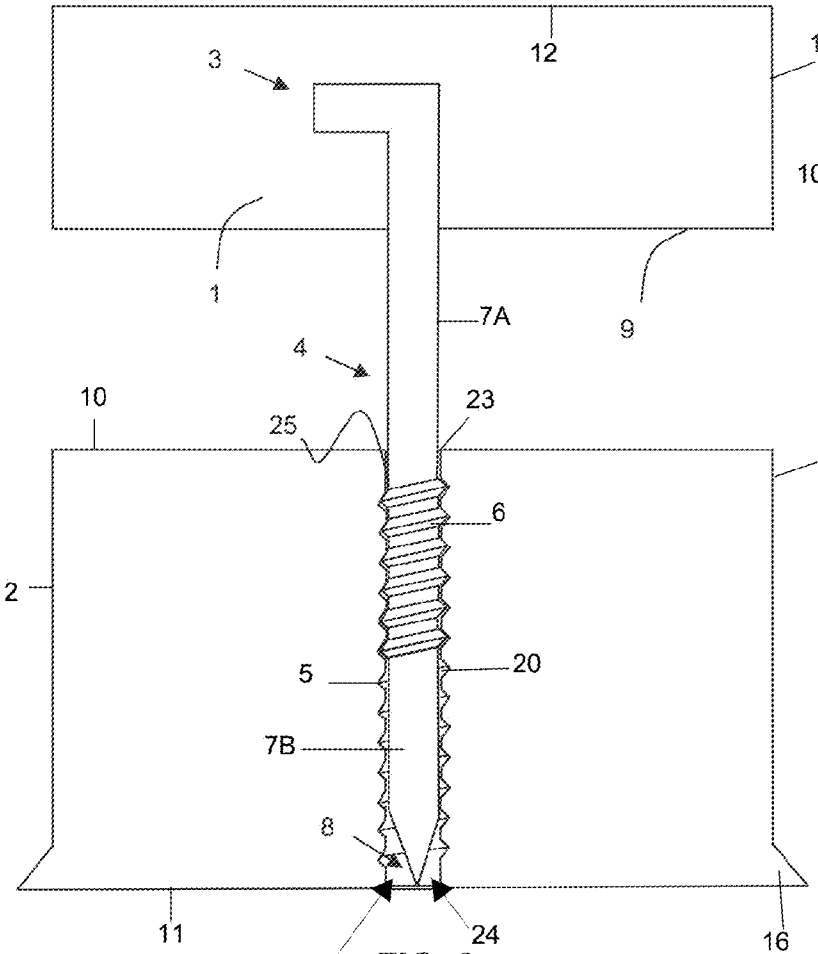
Figure 5:
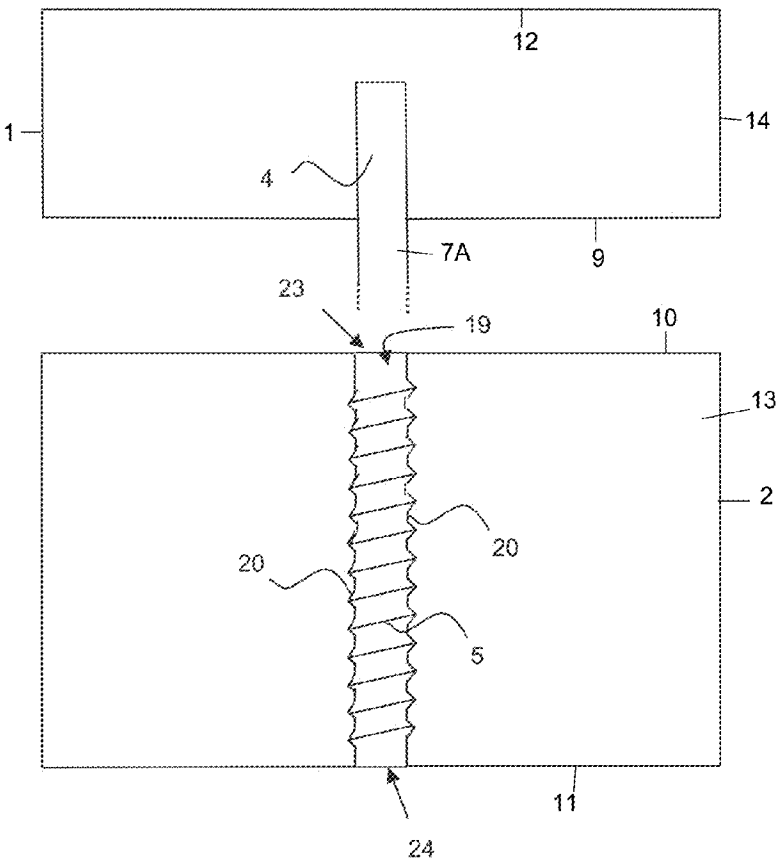
Figure 15:
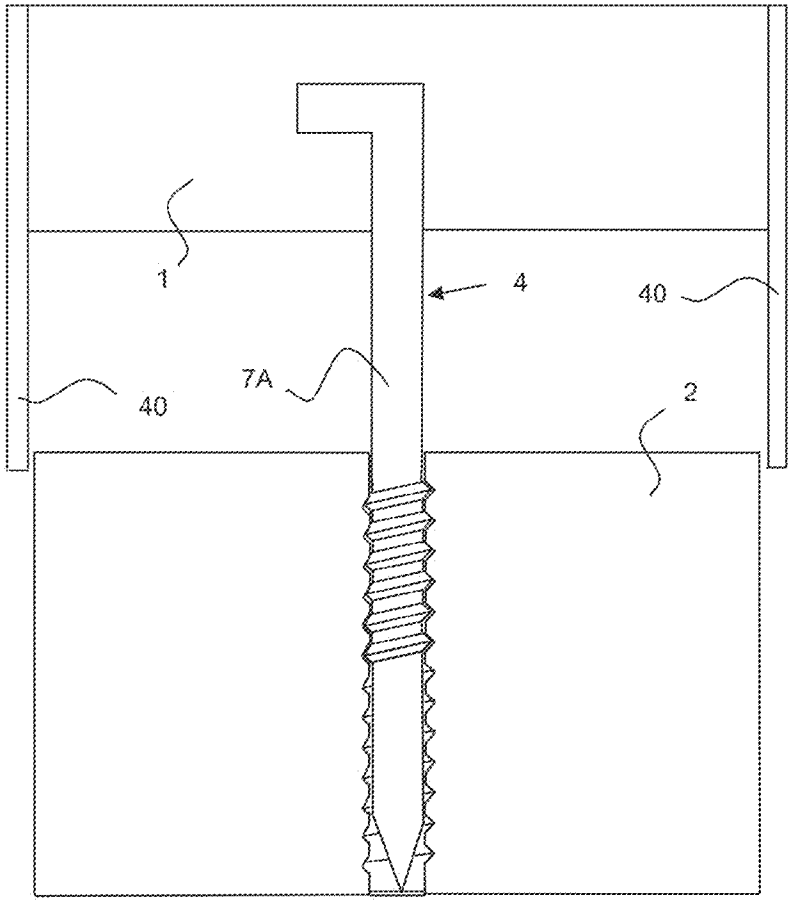

FIGS. 1-11, 15 and 16 depict embodiments of the tack where the pin 4 includes a thread 6 that mates with a thread 5 of a second member 2 that resides on the wall 20 of the hole 19. The mating of the threads 5 and 6 enables the pin 4 to turn in and out of the head. Preferably, the pin 4 turns in and out of the head by turning the first member 1 with respect to the second member 2. FIGS. 1, 3, and 15 specifically illustrate cross-sectional views of embodiments of the tack, where the tack is in a state that prevents the point 8 of the pin 4 from puncturing an object. FIGS. 2 and 4 are similar views of embodiments of the tack, where the tack is in a state that allows the point 8 of the pin 4 to puncture an object. FIG. 5 illustrates an incomplete cross-sectional perspective of an embodiment of the safety tack, where the pin 4 is missing from cross-sectional view of the second member 2 to facilitate understanding of the elements of the hole 19 of the second member 2.

Figure 18:
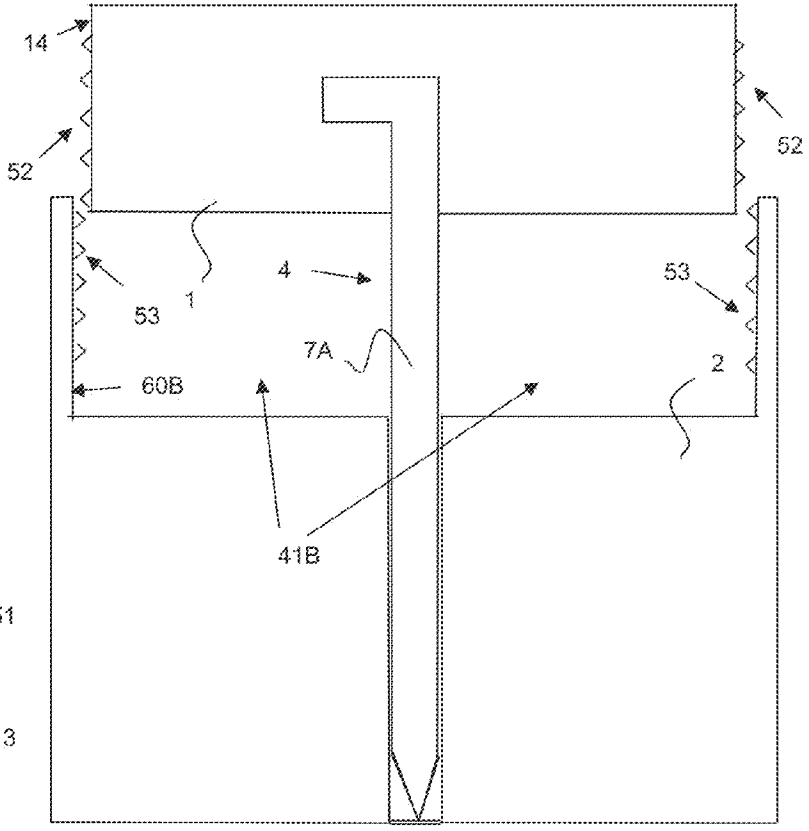
Figure 17:
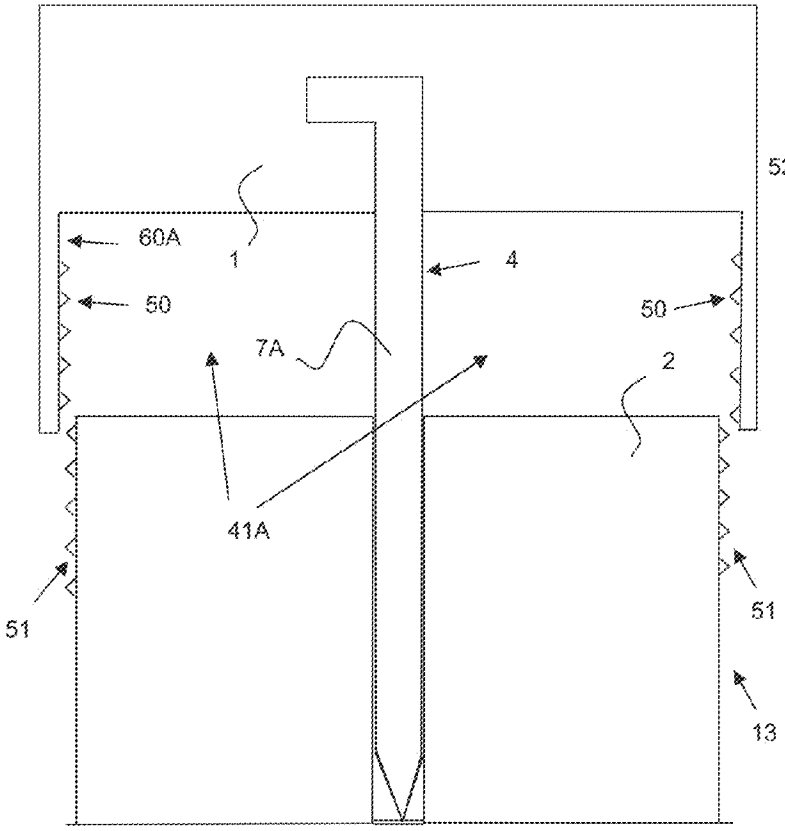
Figure 20:
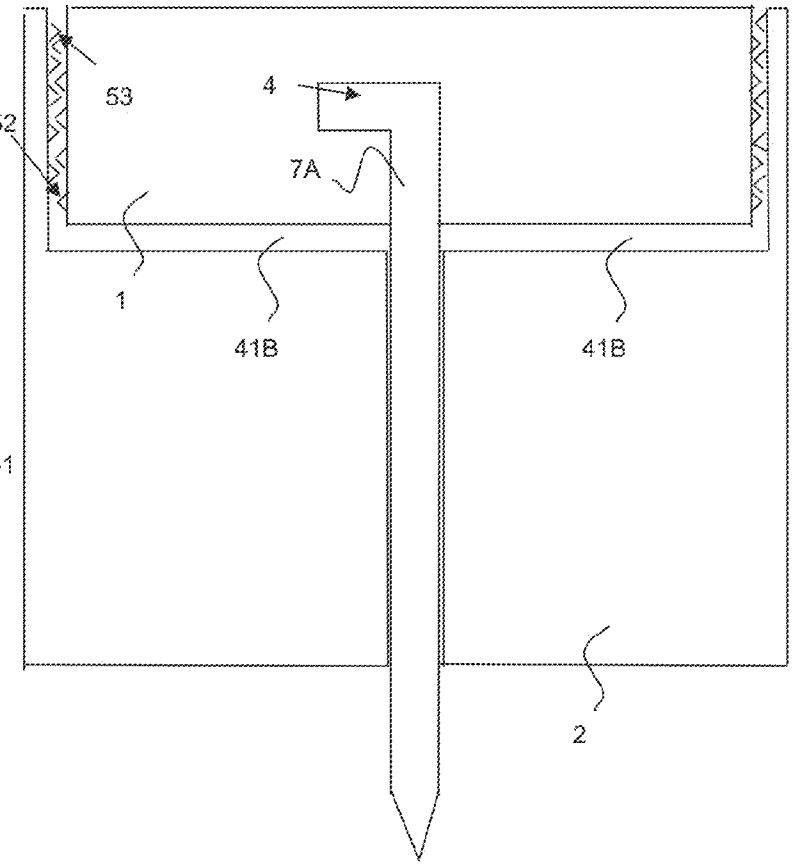
Figure 19:
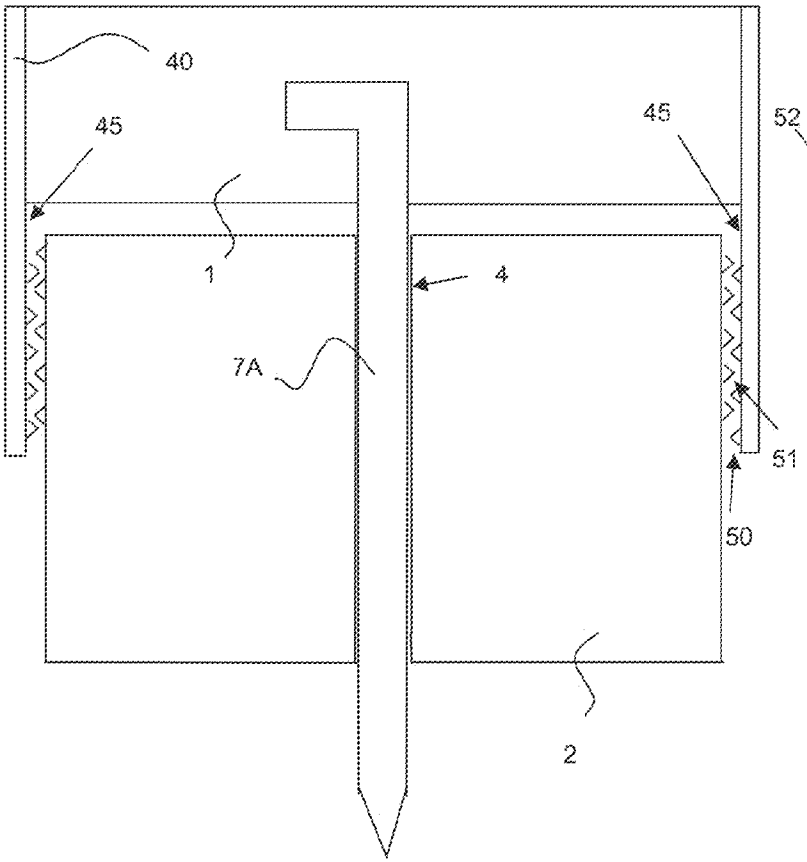
Figures 21, 22:
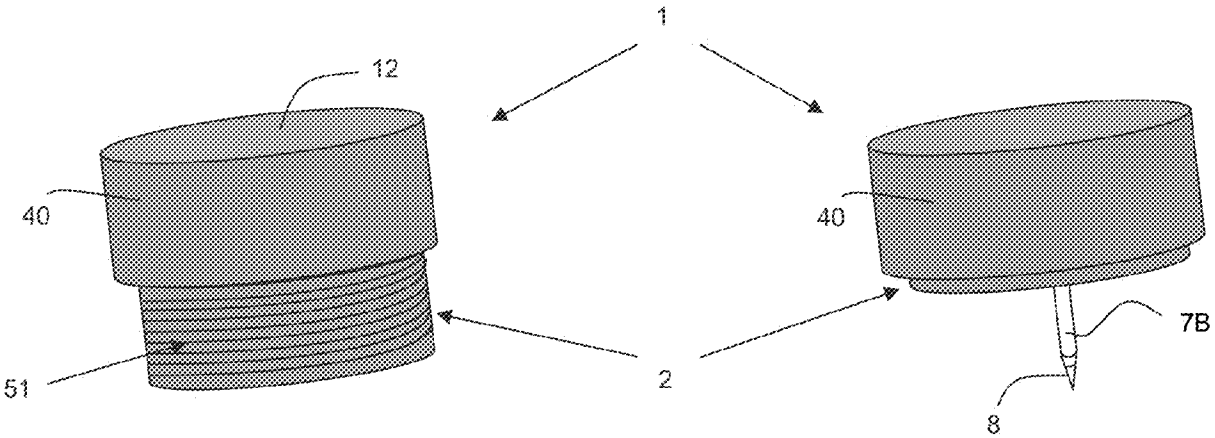
FIGS. 21-24 illustrate example embodiments of the safety tack of the invention.

FIGS. 1, 3, 6, 8, and 10 depict embodiments of the tack where a top portion 7A (See FIG. 1) of the pin 4 is mostly exposed when the tack is in the retracted state; however, in other embodiments, a sheath 40 may be attached to the first member 1 (See FIGS. 15 and 19) or the second member 2 (See FIG. 16), so that the top portion 7A of the pin 4 is not mostly exposed or completely unexposed. In other embodiments of the tack, a hollowed out portion 41A & 41B of either the first member 1 or the second member 2 (See FIGS. 17, 18, and 20) allows the top portion 7A to be completely or for the most part unexposed.

FIGS. 17-24 depict embodiments of the tack where an inner wall 45, 60A, & 60B of the first member 1 or second member 2 includes a thread 50 and 53 that in turn mates with another thread 51 & 52 wrapped about an outer surface 13 of the second member 2 or the outer surface 14 of the first member 1 respectively. Preferably, the wall 60A & 60B exists because the first 1 or second members 2 are hollowed out to a degree. In another embodiment, a sheath 40 wraps around the first member 1 (See FIG. 19) or second member 2 creating the wall 45.

Figure 14:
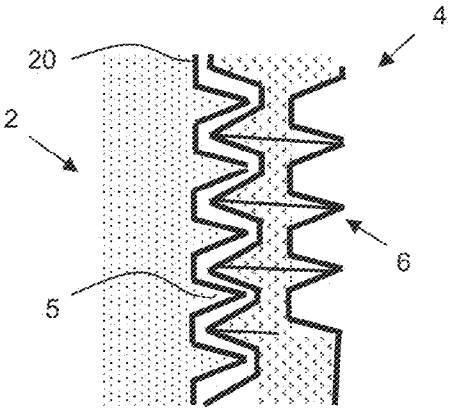
FIGS. 12-14 illustrate example cross-sectional perspectives focusing on threads of embodiments of the safety tack of the invention.
Figure 13:
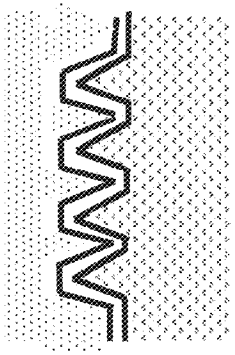
Figure 12:
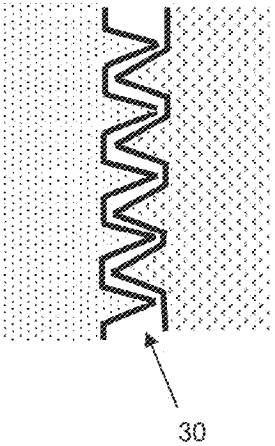
Figure 16:
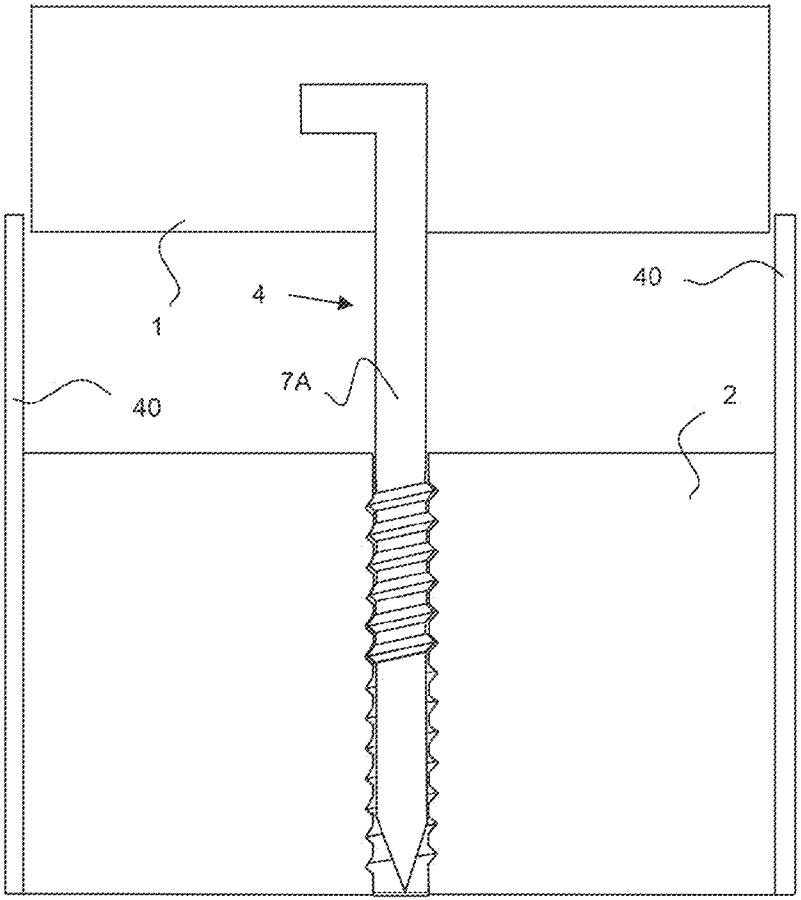

FIGS. 12-14 illustrate cross-sectional perspectives focusing on threads of embodiments of the tack. The threads of the safety tack are external or internal. It is preferred that one of the two complementary threads 5, 6 is internal and the other is external, as shown in FIG. 13, where the thread on the left is internal and the thread on the right is external.

In FIG. 12, the complementary threads are both external threads. Such an embodiment is not preferred because the space 30 makes the tack flimsy and more susceptible to wear.

Another threading combination that makes the tack susceptible to wear is shown in FIG. 14, where the thread 5 of the wall 20 of the hole 19 of the second member 2 is an external thread and the thread 6 of the pin 4 is an internal thread. Such an embodiment has a lack of material in the treaded portion of the pin 4, which causes the pin 4 to break much easier than if the threading was external threading.

Figure 7:
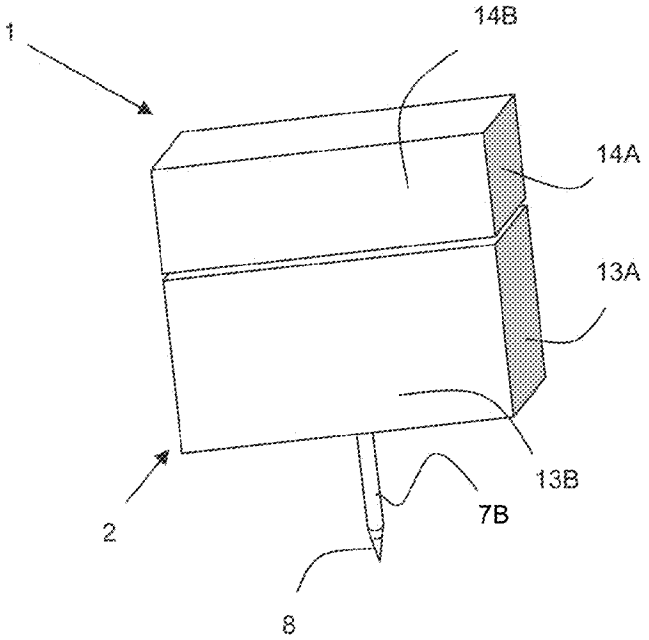
FIGS. 6 and 7 illustrate example rectangular embodiments of the safety tack of the invention.
Figure 6:
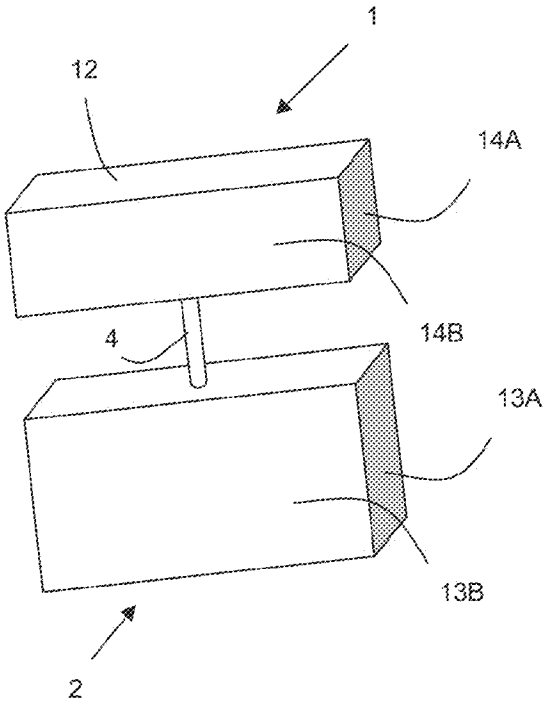
Figures 8, 9:
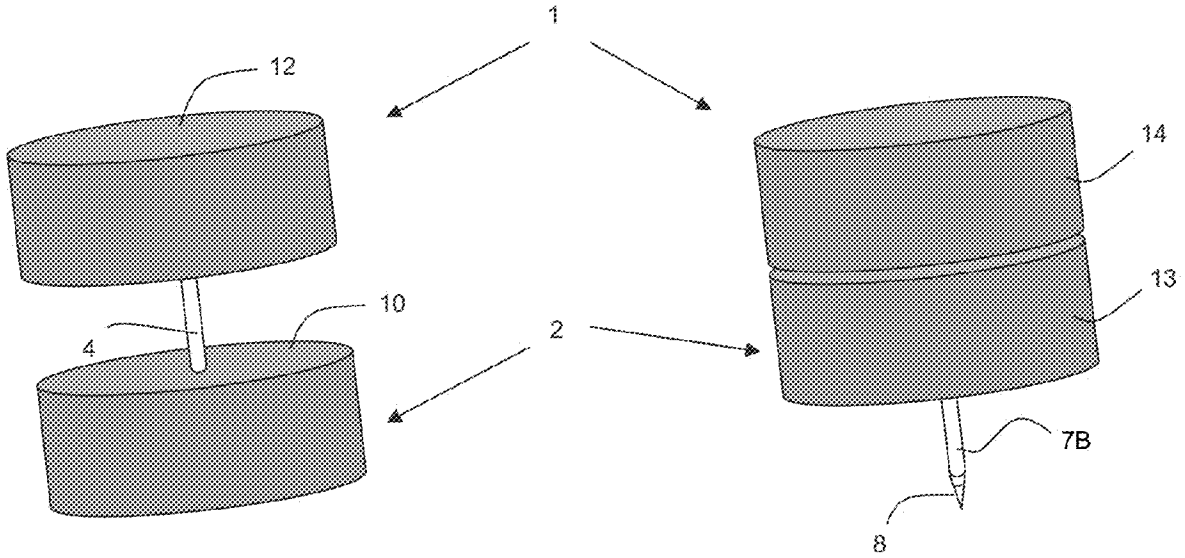
FIGS. 8-11 illustrate example cylindrical embodiments of the safety tack of the invention.
Figures 10, 11:
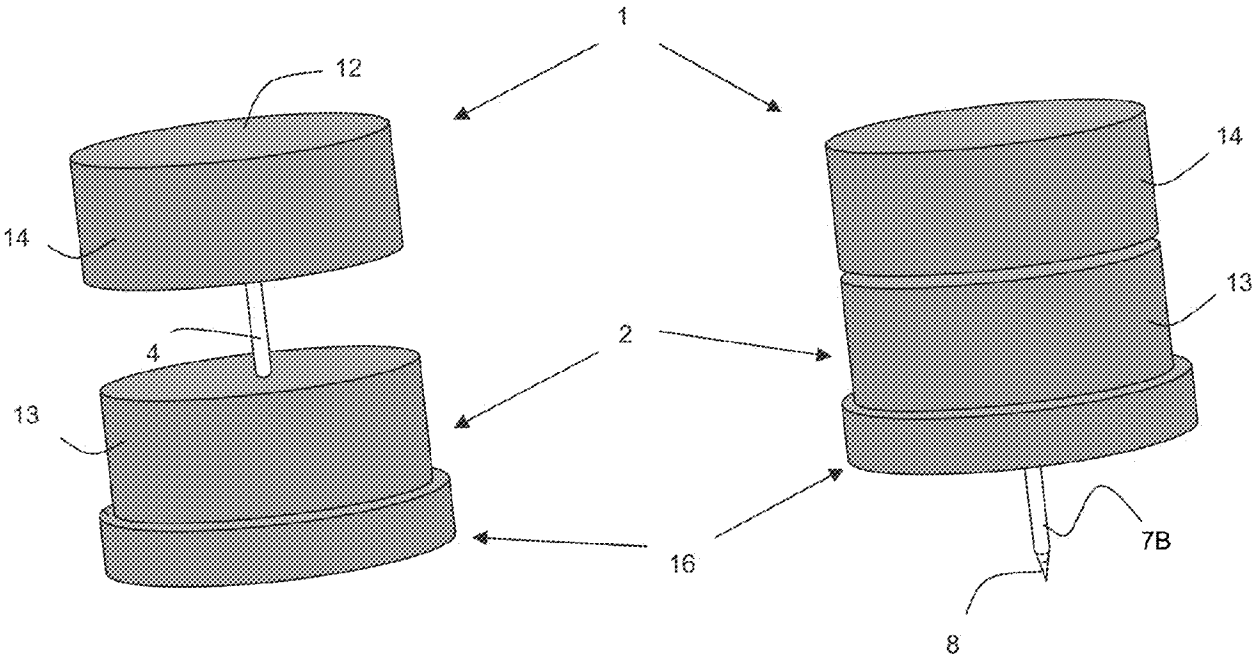
Figures 23, 24:
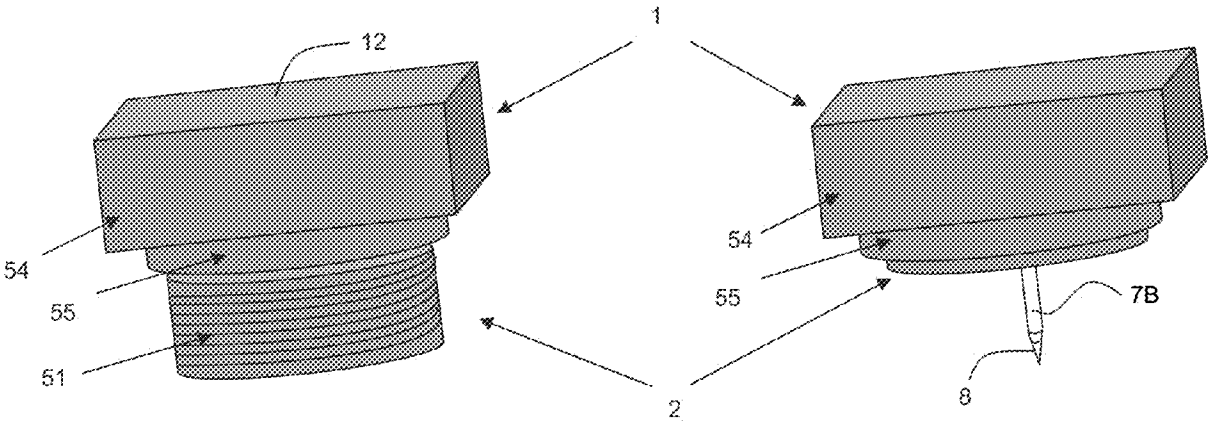

FIGS. 6 and 7 illustrate rectangular embodiments of the tack where the first member 1 has straight sides 14A and 14B and the second member 2 has straight sides 13A and 13B. FIGS. 8-11, 21, and 22 illustrate cylindrical embodiments of the tack, while FIGS. 23 and 24 illustrate mixed-shaped embodiments of the tack, where the first member includes a rectangular element 54 about a cylindrical element 55 and where the cylindrical element 55 provides a hollowed out section with a thread that allows the thread 51 of the second member 2 to mate with the thread of the first member 1. The rectangular element 54 eases the turning of the first member 1 by hand or by tool, and it is possible that the element 54 is hexagonal or another shape with any number of sides, gnarled or smooth. Additionally, as shown in FIGS. 3, 4, 10, and 11, the second member 2 possibly includes a ridge 16 that further facilitates turning the members 1 and 2 of the tack and eases pushing the tack into another object.

Though various embodiments of the present invention have been described above, it should be understood that embodiments have been presented by way of example, and not limitation. A person of ordinary skill in the art will recognize that there are various changes that can be made to the present invention without departing from the spirit and scope of the present invention. Therefore, the invention should not be limited by any of the above-described example embodiments, but should be defined only in accordance with the following claims and equivalents of the claimed invention.

What is claimed:

1. A tack comprising a head having a first member and a second member and a pin having a point, where an end of the pin opposite the point is fixed to the first member, the point of the pin extending out of the head and retracting into the head by a turning mechanism, and the turning mechanism being enabled by a thread of the pin complementing a thread of the second member where the second member has a hole extending completely through the second member to an opposite end of the second member, said second member having a perimeter and said opposite end having a substantially flat surface extending to said perimeter, the hole including the thread of the second member and enabling the point of the pin to extend through the second member and out said opposite end and to be retracted into the second member when one of the first member and second member is turned through mating with the thread of the pin, further comprising a mechanical stop that allows the pin to retract fully into the head without the first member and the second member disconnecting.

2. The tack of claim 1, where:

the pin further comprises a bottom portion and a top portion;

the first member further comprises a top surface, a bottom surface, and at least one side surface;

the second member further comprises a top surface, a bottom surface, at least one side surface;

the hole extends completely through the second member, from the top surface of the second member to the bottom surface of the second member, and the hole comprises a top opening and a bottom opening;

where the mating of the threads of the second member and the pin allows the pin to turn into the second member to an extent that the bottom portion and the point of the pin extends out of the bottom opening of the second member; and where the mating of the threads of the second member and the pin prevents the first member and the second member from disconnecting when the pin is turned into the second member to an extent that at least the point of the pin is retracted fully into the bottom opening of the second member.

3. The tack of claim 1, where a sheath is attached to at least one of the side surfaces of one of the members to limit exposing the top portion of the pin.

4. The tack of claim 1, where one of the members comprises a hollowed out section that allows the other member to fit into the hollowed out section to limit exposing the top portion of the pin.

* * * * *